US006298860B1

(12) United States Patent
Hampl, Jr. et al.

(10) Patent No.: US 6,298,860 B1
(45) Date of Patent: Oct. 9, 2001

(54) PROCESS FOR IMPROVING THE ASH CHARACTERISTICS OF A SMOKING ARTICLE

(75) Inventors: Vladimir Hampl, Jr., Roswell; Kerry Mahone, Alpharetta, both of GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 0 days.

(21) Appl. No.: 09/396,583

(22) Filed: Sep. 15, 1999

(51) Int. Cl.[7] ..... A24D 1/02

(52) U.S. Cl. ..... 131/365; 131/360; 162/139; 162/181.2; 162/181.4; 162/158

(58) Field of Search ..... 131/365, 360; 162/139, 181.2, 181.4, 158

(56) References Cited

U.S. PATENT DOCUMENTS

| | | | |
|---|---|---|---|
| 4,146,040 | 3/1979 | Cohn . | |
| 4,231,377 | 11/1980 | Cline et al. . | |
| 4,407,308 | 10/1983 | Baker et al. . | |
| 4,452,259 | 6/1984 | Norman et al. . | |
| 4,461,311 | 7/1984 | Mathews et al. . | |
| 4,489,739 | 12/1984 | Mattina, Jr. et al. . | |
| 4,615,345 | 10/1986 | Durocher . | |
| 4,622,983 | 11/1986 | Mathews et al. . | |
| 4,624,268 | 11/1986 | Baker et al. . | |
| 4,739,775 | 4/1988 | Hampl, Jr. . | |
| 4,779,631 | 10/1988 | Durocher et al. . | |
| 4,805,644 * | 2/1989 | Hampl, Jr. et al. | 131/365 |
| 5,060,674 | 10/1991 | Brown et al. . | |
| 5,103,844 | 4/1992 | Hayden et al. . | |
| 5,143,099 | 9/1992 | Le Gars et al. . | |
| 5,161,550 | 11/1992 | Owens, Jr. . | |
| 5,263,999 | 11/1993 | Baldwin et al. . | |
| 5,271,419 | 12/1993 | Arzonico et al. . | |
| 5,417,228 | 5/1995 | Baldwin et al. . | |
| 5,730,840 | 3/1998 | Hampl, Jr. et al. . | |
| 5,888,348 | 5/1999 | Hampl, Jr. et al. . | |
| 5,893,372 | 4/1999 | Hampl, Jr. . | |

FOREIGN PATENT DOCUMENTS

| | | |
|---|---|---|
| 0426459 A2 | 10/1990 | (EP) . |
| 0426459 A3 | 10/1990 | (EP) . |

* cited by examiner

*Primary Examiner*—Stanley S. Silverman
*Assistant Examiner*—Mark Halpern
(74) *Attorney, Agent, or Firm*—Dority & Manning, P.A.

(57) ABSTRACT

The present invention is directed to a method for improving the ash characteristics of a paper wrapper for a smoking article and for improving the ash characteristics of the smoking article itself. Specifically, it has been discovered that the ash characteristics of a paper wrapper are noticeably improved when the paper is treated with a carboxylic acid salt solution having a pH of from about 5.5 to about 8.0. The carboxylic acid salt solution can be for instance, an aqueous solution containing a metal succinate or a metal citrate.

27 Claims, No Drawings

PROCESS FOR IMPROVING THE ASH CHARACTERISTICS OF A SMOKING ARTICLE

FIELD OF THE INVENTION

The present invention is generally directed to a method for improving the ash characteristics of a paper used to construct smoking articles. More particularly, the present invention is directed to a process for improving the ash characteristics of a cigarette paper by applying to the paper a carboxylic acid salt solution, preferably succinate solution or citrate solution, having a pH of less than about 8.0.

BACKGROUND OF THE INVENTION

Smoking articles such as cigarettes are conventionally made by wrapping a column of tobacco in a white wrapping paper. At one end, the smoking article usually includes a filter through which the article is smoked. Filters are attached to smoking articles using a tipping paper which is glued to the white wrapping paper. The wrapping papers and tipping papers used to construct smoking articles are typically made from flax or other cellulosic fibers and contain a filler, such as calcium carbonate.

Besides being used to hold the cigarette together, cigarette wrapping papers and tipping papers also contribute to and control many physical properties and characteristics of the cigarette. For instance, cigarette wrapping paper affects the rate at which the cigarette burns, the number of puffs per cigarette and the total tar delivery per puff. Another property of the cigarette that is affected by the wrapper is the appearance and characteristics of the ash that is formed as the cigarette burns. Ideally, cigarette ash should be cohesive, should not flake off from the cigarette, and should have an aesthetically pleasing appearance.

The quality of cigarette ash is generally determined by rating the ash according to four criteria. The first criteria is ash color. In general, a whiter ash has a more aesthetic appearance and is thus more desirable.

Another important characteristic of cigarette ash is its cohesiveness and its ability to avoid excessive flaking. The ash should not flake off the cigarette unless the cigarette is flicked or tapped on an object. Further, once the cigarette is tapped, the ash should break off in clumps and not disintegrate.

The last two criteria used to evaluate cigarette ash are dependent for the most part upon the cigarette wrapping paper and not upon the ash characteristics of the tobacco column. For example, cigarette ash is also evaluated by the thickness of the char line appearing on the wrapper as a cigarette is burned. Thinner char lines are preferred.

Finally, the last criteria is the extent to which the cigarette wrapper stains downstream (towards the filter) from the ash as the cigarette is smoked. A high quality wrapping paper will not stain or discolor throughout the length of the cigarette as the cigarette is puffed.

In the past, various methods have been devised in order to improve the ash characteristics of a smoking article. For instance, previous efforts for improving the appearance of ash have included changing the type of cellulosic fiber used to make the cigarette wrapping paper. Also, ash modifiers have been added to the paper or to the tobacco.

However, a need still remains for a method of improving cigarette ash characteristics without affecting the other properties of the cigarette. In particular, a need exists for a method that improves the ash characteristics of a cigarette wrapping paper without adversely affecting the permeability of the paper, or the taste, the burn rate, the puff count, or the tar delivery per puff of a cigarette incorporating the paper.

SUMMARY OF THE INVENTION

The present invention recognizes and addresses various deficiencies of prior art constructions and methods.

Accordingly, it is an object of the present invention to provide a method for improving the ash characteristics of a cigarette paper and of a cigarette incorporating the paper.

Another object of the present invention is to provide a method for improving the ash characteristics of a cigarette paper without affecting the taste of a cigarette incorporating the paper.

It is another object of the present invention to provide a method for improving the ash characteristics of a cigarette paper by treating a wrapping paper for a smoking article with a carboxylic acid salt solution possessing a pH of less than 8.0 such as but not limited to an aqueous succinate solution.

Another object of the present invention is to provide a method for improving the ash characteristics of a cigarette paper by applying to the paper a size composition that comprises a succinate solution made by combining a metal hydroxide with succinic acid wherein the pH of the solution is from about 5.5 to about 8.0.

It is yet another object of the present invention to provide a method for improving the ash characteristics of a cigarette paper by treating a wrapping paper for a smoking article with a carboxylic acid salt solution having a pH of less than about 8.0 such as but not limited to an aqueous citrate solution.

Still another object of the present invention is to provide a method for improving the ash characteristics of a cigarette paper by applying to the paper a size composition that comprises a citrate solution made by combining a metal hydroxide with citric acid wherein the pH of the solution is from about 5.5 to about 8.0.

These and other objects are achieved by providing a process for improving the ash characteristics of a paper wrapper for a smoking article. The process includes the steps of providing a paper wrapper designed to be incorporated into a smoking article. The paper wrapper is made from a fibrous web containing a filler. The paper wrapper can have a basis weight of from about 18 gsm to about 60 gsm, and particularly from about 22 gsm to about 35 gsm. The paper wrapper can also have a permeability of from about 5 Coresta units to about 80 Coresta units, and particularly from about 15 Coresta units to about 55 Coresta units.

In accordance with the present invention, the paper wrapper can be treated with a carboxylic acid salt, such as a dicarboxylic acid salt, preferably an aqueous succinate solution having a pH of from about 5.5 to 8.0. By applying a succinate solution within the above stated pH range, the ash characteristics of the paper and of a smoking article incorporating the paper can be unexpectedly improved. The succinate solution can be made by combining a metal hydroxide with succinic acid. The metal hydroxide can be, for instance, sodium hydroxide, potassium hydroxide, or mixtures thereof. In one preferred embodiment, the aqueous succinate solution has a pH of from about 6.5 to about 7.0.

When applied to the paper wrapper, the aqueous succinate solution can have a succinate concentration of from about 6% to about 32% by weight. The solution can be applied to the paper wrapper such that the wrapper contains from about 0.1% to about 16% by weight succinate and particularly from about 8% to about 11% by weight succinate. For most applications, the succinate solution is applied to the paper as a size composition. The succinate solution can be applied to one side of the paper or to both sides of the paper.

In another embodiment of the present invention, the wrapper is treated with a hydroxytricarboxylic acid salt, preferably an aqueous citrate solution having a pH of from about 5.5 to 8.0. The present inventors have discovered that by applying a citrate solution within the above defined pH range, the ash characteristics of the paper and of a smoking article incorporating the paper can be unexpectedly improved. The citrate solution can be made by combining a metallic hydroxide with citric acid. The metal hydroxide can be, for instance, sodium hydroxide, potassium hydroxide, or mixtures thereof.

When applied to the paper wrapper, the aqueous citrate solution can have a citrate concentration of from about 0.1% to about 16% by weight and particularly from about 1% to about 11% by weight citrate. For most applications, the citrate solution is applied to the paper as a size composition. The citrate solution can be applied to one side of the paper or to both sides of the paper.

Other objects, features and aspects of the present invention are discussed in greater detail below.

DETAILED DESCRIPTION OF PREFERRED EMBODIMENTS

It is to be understood by one of ordinary skill in the art that the present discussion is a description of exemplary embodiments only and is not intended as limiting the broader aspects of the present invention which broader aspects are embodied in the exemplary construction.

The present invention is generally directed to a method for improving the ash characteristics of wrapping paper for improving the ash characteristics of a smoking article incorporating the wrapping paper. In particular, the present inventors have discovered that the ash characteristics of a wrapping paper can be improved by adding to the paper a carboxylic acid salt solution, such as a succinate solution or citrate solution within a narrowly defined pH range, specifically within a pH range of from about 5.5 to about 8.0. Further, the ash characteristics of the paper are improved according to the present invention without altering or adversely affecting the taste of the cigarette.

In the past, cigarette papers have been treated with potassium succinate or sodium succinate in order to decrease sidestream smoke. For instance, U.S. Pat. No. 4,805,644 (co-invented by one of the current inventors), U.S. Pat. No. 5,060,674, and U.S. Pat. No. 5,450,862, which are all incorporated herein by reference, are all directed to sidestream reducing cigarette paper that disclose the use of succinate salts. Various advantages of the present invention, however, remain absent from the prior art.

Specifically, the present inventors have discovered that the ash characteristics of a wrapping paper can be improved by adjusting the pH of a succinate or citrate solution that is applied to the paper. In general, a succinate solution is made by combining succinic acid with a base, such as a metal hydroxide. A citrate solution is made by combining a citric acid with a base, such as a metal hydroxide. According to the present invention, it has been discovered that ash color can be affected by varying the ratio between the base and the succinic or citric acid that are used in forming the succinate solution or citrate solution, respectively. More particularly, it has been discovered that as the ratio of the base to succinic or citric acid increases above the stoichiometric ratio, the ash color becomes darker and less desirable. Thus, according to the present invention, preferably the amount of base that is used in forming the succinate or citrate solution is minimized. Specifically, in order to achieve the lightest ash color possible and thus the best result, the succinate or citrate solution should preferably have a pH of about 8 or below and preferably above about 5.5 when the solution is applied to the paper.

The construction of a cigarette wrapping paper made in accordance with the present invention will now be discussed in greater detail. Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

Besides cellulosic fibers, the paper can also contain a filler. The filler incorporated into the paper can be made from various different materials. For instance, the filler can be calcium carbonate particles, magnesium oxide particles or a mixture of different types of particles. In general, the total filler loading added to the paper wrapper can be between about 20% to about 40% by weight, and particularly between about 25% to about 35% by weight.

In one preferred embodiment of the present invention, the filler incorporated into the paper is a white filler having a particular median particle size. For instance, U.S. Pat. No. 5,730,840 to Hampl, et al., which is incorporated herein by reference, discloses that by incorporating into a paper wrapper, a filler, such as calcium carbonate, having a particle size of from about 0.15 microns to about 0.5 microns and particularly from about 0.2 microns to about 0.4 microns also improves the ash characteristics of the paper and of a smoking article incorporating the paper.

The permeability of a paper wrapper for smoking articles made according to the present invention can be generally from about 5 Coresta units to about 80 Coresta units. In most applications, the permeability should be between about 15 Coresta units to about 55 Coresta units.

The basis weight of cigarette wrapping paper is usually between about 18 gsm to about 60 gsm and more particularly between about 22 gsm to about 32 gsm. Wrapping papers according to the present invention can be made within any of these ranges.

As described above, the present invention is directed to applying to a paper wrapper a carboxylic acid salt solution within a narrowly defined pH range. For instance, in one embodiment, a carboxylic acid salt solution can be used such as a succinate or citrate solution. In general, a carboxylic acid salt solution can have a pH of from about 5.5 to about 8.0 and particularly from about 6.5 to about 7.0 in order to improve the ash characteristics of the paper and a smoking article constructed with the paper.

In one embodiment, the succinate solution used to treat the paper is produced by combining base with succinic acid in amounts so that the solution falls within the above defined pH range. The base, again, is preferably a metal hydroxide, such as sodium hydroxide or potassium hydroxide which then form sodium succinate and potassium succinate respectively when combined with succinic acid.

In another embodiment, the citrate solution used to treat the paper is produced by combining a base with citric acid in amounts so that the solution falls within the above defined pH range. The base preferably is a metal hydroxide, such as sodium hydroxide or potassium hydroxide which then form sodium citrate and potassium citrate respectively when combined with citric acid.

Succinate and citrate solutions made according to the present invention are preferably applied to the paper wrapper after the paper has been formed instead of being added during formation of the paper. For instance, the succinate and citrate solutions can be applied as a size agent and can be applied to the paper, for example, using a size press.

The succinate and citrate solutions can be applied to only one side of the paper or can be applied to both sides of the paper. For most applications, the succinate or citrate is applied as an aqueous solution.

In general, the solution can be sprayed on the paper, applied with a size press, printed onto the paper, or the paper can be dipped into the solution. In one embodiment, the solution can be applied to the paper twice using, for instance, a size press.

For most applications, after the solution is applied to the paper, the paper can contain up to about 16% by weight of the carboxylic acid salt. For instance, in one embodiment, the wrapping paper can contain the carboxylic acid salt in an amount from about 0.1% to about 3% by weight, and particularly from about 1% to about 2% by weight. In another embodiment, the paper can contain the carboxylic acid salt in an amount from about 5% to about 12% by weight and more particularly from about 8% to about 11% by weight. At higher amounts, as is known in the past, besides improving ash color, the carboxylic acid salt also reduces sidestream smoke.

EXAMPLE NO. 1

The ash characteristics of paper wrappers treated with different solutions of potassium hydroxide and succinic acid were examined. In particular, various solutions of potassium succinate were applied to a conventionally made paper wrapper. The paper wrapper had a basis weight of about 25 gsm and contained a calcium carbonate filler.

The following reaction was used to produce the succinate salt solution which was applied to the paper:

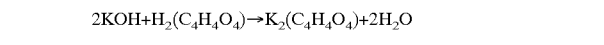

$$2KOH+H_2(C_4H_4O_4)\rightarrow K_2(C_4H_4O_4)+2H_2O$$

The following solutions in the following amounts were then applied to the paper wrapper:

| Percentage of Potassium Succinate Applied to Paper (%) | Percentage of Stoichiometric Amount of Potassium Hydroxide (%) | pH |
|---|---|---|
| 1 | 90 | 6.5 |
| 1 | 95 | 6.8 |
| 1 | 100 | 9.5 |
| 1 | 105 | 12.9 |
| 1 | 110 | 13.1 |
| 3 | 90 | 6.5 |
| 3 | 95 | 6.8 |
| 3 | 100 | 9.5 |
| 3 | 105 | 12.9 |
| 3 | 110 | 13.1 |
| 8 | 90 | 6.5 |
| 8 | 95 | 6.8 |
| 8 | 100 | 9.5 |
| 8 | 105 | 12.9 |
| 8 | 110 | 13.1 |

Cigarettes were hand rolled from the paper wrapper treated with the various succinate solutions. The cigarettes were lit and allowed to burn freely. As the cigarette burned, the formed ash was observed and evaluated.

From this example, it was discovered that the color of the cigarette ash noticeably improved when succinate solution was more acidic. Further, it was noticed that the change was more noticeable as greater amounts of succinate were applied to the paper.

EXAMPLE NO. 2

Substantially the same test described in example number one above was performed using various citrate solutions. The citrate solutions were prepared by combining potassium hydroxide with citric acid. The citrate solutions were applied to a conventional wrapping paper having a basis weight of about 25 gsm. In particular, the following citrate solutions were prepared and applied to the paper in the following amounts:

| Percentage of Potassium Citrate Applied to Paper (%) | Percentage of Stoichiometric Amount of Potassium Hydroxide (%) |
|---|---|
| 1 | 50 |
| 1 | 75 |
| 1 | 100 |
| 1 | 125 |
| i | 150 |

Once again, it was noticed that the ash became noticeably lighter as the pH of the citrate solution decreased.

These and other modifications and variations of the present invention may be practiced by those of ordinary skill in the art, without departing from the spirit and scope of the present invention, which is more particularly set forth in the appended claims. In addition, it should be understood that aspects of various embodiments may be interchanged both in whole or in part. Furthermore, those of ordinary skill in the art will appreciate that the foregoing description is by way of example only, and is not intended to limit the description so further described in such appended claims.

What is claimed is:

1. A process for improving the ash characteristics of a paper wrapper for a smoking article comprising:

providing a paper wrapper for a smoking article, said paper wrapper comprising a fibrous web containing a filler, said paper wrapper having a basis weight from about 18 gsm to about 60 gsm and having a permeability of from about 5 Coresta units to about 80 Coresta units; and applying to said paper wrapper an aqueous carboxylic acid salt solution, said aqueous carboxylic acid salt solution having a pH of from about 5.5 to about 8.0, said aqueous carboxylic acid salt solution being formed by combining a metal hydroxide with a carboxylic acid.

2. A process as defined in claim 1, wherein said metal hydroxide comprises a material selected from the group consisting of sodium hydroxide, potassium hydroxide, and mixtures thereof.

3. A process as defined in claim 2, wherein said aqueous carboxylic acid salt solution has a pH of from about 6.5 to about 7.0.

4. A process as defined in claim 1, wherein said aqueous carboxylic acid salt solution is applied to said paper wrapper so that said paper wrapper contains from about 0.1% to about 3% by weight carboxylic acid salt.

5. A process as defined in claim 1, wherein said carboxylic acid comprises a material selected from the group consisting of succinic acid, citric acid, and mixtures thereof.

6. A process as defined in claim 1, wherein said aqueous carboxylic acid salt solution is applied to said paper wrapper so that said paper wrapper contains from about 5% to about 16% by weight carboxylic acid salt.

7. A process as defined in claim 1, wherein said filler is present within said paper wrapper in an amount from about 20% to about 40% by weight.

8. A process as defined in claim 1, wherein said filler comprises calcium carbonate having a median particle size of from about 0.2 to about 0.4 microns.

9. A process for improving the ash characteristics of a paper wrapper for a smoking article comprising the steps of:

providing a paper wrapper for a smoking article comprising a fibrous web containing a filler, said filler being present in said paper wrapper in an amount from about 20% to about 40% by weight, said paper wrapper having a basis weight of from about 18 gsm to about 60 gsm and having a permeability of from about 5 Coresta units to about 55 Coresta units; and applying to said paper wrapper an aqueous carboxylic acid salt solution being made by combining a metal hydroxide with a carboxylic acid, said carboxylic acid comprising a material selected from the group consisting of a succinic acid, citric acid, and mixtures thereof, said aqueous solution having a pH of from about 5.5 to about 8.0 and being applied to said paper wrapper so that said paper wrapper contains up to about 16% by weight of said carboxylic acid salt.

10. A process as defined in claim 9, wherein said metal hydroxide comprises sodium hydroxide.

11. A process as defined in claim 9, wherein said metal hydroxide comprises potassium hydroxide.

12. A process as defined in claim 9, wherein said aqueous solution has a pH of from about 6.5 to about 7.0.

13. A process as defined in claim 9, wherein said filler comprises calcium carbonate having a median particle size of from about 0.2 microns to about 0.4 microns.

14. A process as defined in claim 9, wherein said aqueous solution is applied to said paper wrapper in an amount so that said paper wrapper contains from about 0.1% to about 3% by weight of said carboxylic acid salt.

15. A process as defined in claim 9, wherein said carboxylic acid comprises succinic acid.

16. A process as defined in claim 9, wherein said carboxylic acid comprises citric acid.

17. A process as defined in claim 9, wherein said aqueous solution is applied to said paper wrapper in an amount so that said paper wrapper contains from about 8% to about 11% by weight of said carboxylic acid salt.

18. A process for improving the ash characteristics of a smoking article comprising the steps of:

providing a paper wrapper comprising a fibrous web containing a filler, said filler being present within said wrapper in an amount from about 20% to about 40% by weight, said paper wrapper having a basis weight of from about 18 gsm to about 60 gsm and having a permeability of from about 5 Coresta units to about 55 Coresta units;

applying to said paper wrapper an aqueous carboxylic acid salt solution, said carboxylic acid salt solution being formed by combining a metal hydroxide with a carboxylic acid, said carboxylic acid comprising a material selected from the group consisting of succinic acid, citric acid, and mixtures thereof, said metal hydroxide comprising a material selected from the group consisting of sodium hydroxide, potassium hydroxide, and mixtures thereof, said aqueous carboxylic acid salt solution having a pH of from about 5.5 to about 8.0; and wrapping said paper wrapper around a column of tobacco in order to form a smoking article.

19. A process as defined in claim 18, wherein said carboxylic acid salt solution comprises a succinate solution.

20. A process as defined in claim 18, wherein said carboxylic acid salt solution comprises a citrate solution.

21. A process as defined in claim 18, wherein said aqueous solution is applied to said paper wrapper in an amount such that said paper wrapper contains from about 0.1% to about 16% by weight carboxylic acid salt.

22. A process as defined in claim 18, wherein said aqueous solution has a pH of from about 6.5 to about 7.0.

23. A process as defined in claim 18, wherein said paper wrapper has a basis weight of from about 22 gsm to about 35 gsm and has a permeability of from about 15 Coresta units to about 55 Coresta units, said filler being present within said paper wrapper in an amount from about 25% to about 35% by weight.

24. A process as defined in claim 19, wherein said succinate solution is applied to said paper wrapper in an amount such as said paper wrapper contains from about 0.1% to about 3% by weight succinate.

25. A process as defined in claim 19, wherein said succinate solution is applied to said paper wrapper in an amount such that said paper wrapper contains from about 5% to about 11% by weight succinate.

26. A process as defined in claim 20, wherein said citrate solution is applied to said paper wrapper in an amount such that said paper wrapper contains from about 0.1% to about 3% by weight citrate.

27. A process as defined in claim 20, wherein said citrate solution is applied to said paper wrapper in an amount such that said paper wrapper contains from about 5% to about 11% by weight citrate.

* * * * *